United States Patent [19]

Zammit et al.

[11] 4,262,291

[45] Apr. 14, 1981

[54] ARABIC NUMERICAL DISPLAYS USING SEGMENTED PATTERNS

[76] Inventors: Christopher C. Zammit, 6 Boveney House, Segsbury Grove, Bracknell, Berkshire, RG12 3JX, England; Peter L. R. Morse, 67 Wellington Rd., Enfield, Middlesex, England

[21] Appl. No.: 919,310

[22] Filed: Jun. 26, 1978

[30] Foreign Application Priority Data

Jul. 1, 1977 [GB] United Kingdom ..... 27663/77

[51] Int. Cl.[3] ..... G09F 9/32

[52] U.S. Cl. ..... 340/756; 340/765; 340/790

[58] Field of Search ..... 340/760, 762, 756, 790, 340/765, 757, 759

[56] References Cited

U.S. PATENT DOCUMENTS

| | | | |
|---|---|---|---|
| 3,327,153 | 6/1967 | Bickmire et al. | 340/759 |
| 3,573,532 | 4/1971 | Boucher | 340/760 |
| 3,863,249 | 1/1975 | Olah | 340/757 |
| 4,122,444 | 10/1978 | Kitajima et al. | 340/790 |

*Primary Examiner*—Marshall M. Curtis
*Attorney, Agent, or Firm*—Diller, Ramik & Wight

[57] ABSTRACT

The invention provides apparatus for visibly displaying Arabic numerals or symbols e.g. arithmetic symbols for use in devices such as calculators, digital clocks etc. The apparatus comprises a decoder adapted to convert an input signal (e.g. a BCD signal) representing a numeral or symbol in one system of numerals and symbols of the European System (as herein defined), to an output signal representing the corresponding Arabic language numeral or symbol, the output signal being used to illuminate or otherwise make visible a dot or a line segment of a 13, 14, 15 or 16 line segment display, preferably a liquid crystal display, to make visible the Arabic language numeral or symbol. For multiple digit numerals, an array of line segment displays is provided, the decoder being arranged to obey the rules in the Arabic language system concerning the location of arithmetic and quantity symbols with respect to the numeral when activating the various line segment displays.

9 Claims, 11 Drawing Figures

| | BCD INPUT | ARABIC | A1 | A2 | B | C | D1 | D2 | E | F | G1 | G2 | H | I | J | K | L | M | DOT |
|---|---|---|---|---|---|---|---|---|---|---|---|---|---|---|---|---|---|---|---|
| | 0000 | ٠ | | | | | | | | | | | | | | | | | I |
| | 0001 | ١ | | | | | | | | | | | | I | | | I | | |
| | 0010 | ٢ | | | I | | | | I | I | I | I | | | | | | | |
| | 0010 | ٢ | I | I | | | | | | | | | I | | | I | | | |
| | 0011 | ٣ | | | I | | | | I | I | I | I | | I | | | | | |
| | 0100 | ٤ | I | | | | I | I | | | | | I | | | | | I | |
| | 0101 | ٥ | I | I | I | I | I | I | I | I | | | | | | | | | |
| | 0110 | ٦ | I | I | I | I | | | | | | | | | | | | | |
| | 0111 | ٧ | | | | | | | I | I | | | | | I | | | I | |
| | 1000 | ٨ | | | I | I | | | | | | | | | I | | | I | |
| | 1001 | ٩ | I | I | I | I | | | | I | I | I | | | | | | | |
| | 1010 | — | | | | | | | | | I | I | | | | | | | |
| | 1011 | + | | | | | | | | | I | I | | I | | | I | | |
| RIGHT SLANTED | 0111 | ٧ | | | I | I | | | | | | | I | | | I | | | |
| RIGHT SLANTED | 1000 | ٨ | | | | | | | I | I | | | I | | | I | | | |

FIG. 1.
| ARABIC | EUROPEAN |
|---|---|
| ٠ | 0 |
| ١ | 1 |
| ٢ | 2 |
| ٢ | 2 |
| ٣ | 3 |
| ٤ | 4 |
| ٥ | 5 |
| ٦ | 6 |
| ٧ | 7 |
| ٨ | 8 |
| ٩ | 9 |
FIG. 2.
| ARABIC | EUROPEAN |
|---|---|
| ، | . |
| + | + |
| − | − |
| X | X |
| ÷ | ÷ |
| = | = |
| ٪ | % |
| ) | ) |
| ( | ( |
FIG. 3A.
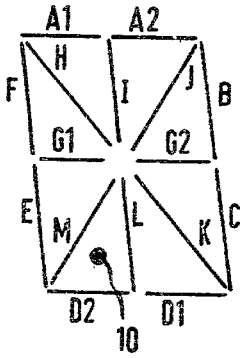
FIG. 3B.
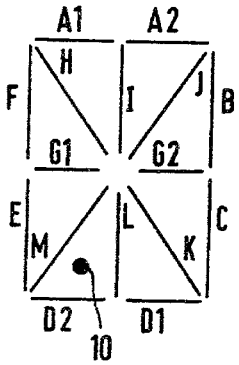
FIG. 3C.
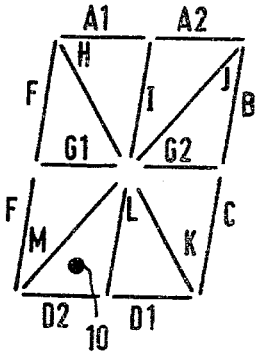

FIG. 4.

| B.C.D INPUT | ARABIC | A1 | A2 | B | C | D1 | D2 | E | F | G1 | G2 | H | I | J | K | L | M | DOT |
|---|---|---|---|---|---|---|---|---|---|---|---|---|---|---|---|---|---|---|
| 0000 | ٠ | | | | | | | | | | | | | | | | | 1 |
| 0001 | ١ | | | | | | | | | | | | 1 | | | 1 | | |
| 0010 | ٢ | | | 1 | | | | 1 | 1 | 1 | 1 | | | | | | | |
| 0010 | ٢ | 1 | 1 | | | | | | | | | 1 | | | 1 | | | |
| 0011 | ٣ | | | 1 | | | | 1 | 1 | 1 | 1 | | 1 | | | | | |
| 0100 | ٤ | 1 | | | | 1 | 1 | | | | | 1 | | | | | 1 | |
| 0101 | ٥ | 1 | 1 | 1 | 1 | 1 | 1 | 1 | 1 | | | | | | | | | |
| 0110 | ٦ | 1 | 1 | 1 | 1 | | | | | | | | | | | | | |
| 0111 | ٧ | | | | | | | 1 | 1 | | | | | 1 | | | 1 | |
| 1000 | ٨ | | | 1 | 1 | | | | | | | | | 1 | | | 1 | |
| 1001 | ٩ | 1 | 1 | 1 | 1 | | | | 1 | 1 | 1 | | | | | | | |
| 1010 | — | | | | | | | | | 1 | 1 | | | | | | | |
| 1011 | + | | | | | | | | | 1 | 1 | | 1 | | | 1 | | |
| RIGHT SLANTED 0111 | ٧ | | | 1 | 1 | | | | | | | 1 | | | 1 | | | |
| RIGHT SLANTED 1000 | ٨ | | | | | | | 1 | 1 | | | 1 | | | 1 | | | |

| | ARABIC | EUROPEAN |
|---|---|---|
| FIG.6A. | ١٩<br>١٩٠<br>١٩٠٠ | 19<br>190<br>1900 |
| FIG.6B. | ١٩—<br>٧٨— | —19<br>—78 |
| FIG.6C. | ١٩,١<br>١٩,١— | 19·1<br>—19·1 |
| FIG.6D. | ١٩,١٪<br>٧٨,١٪ | 19·1%<br>78·1% |

HOURS MINUTES SECONDS

ARABIC NUMERICAL DISPLAYS USING SEGMENTED PATTERNS

The invention relates to apparatus for providing a visual display of Arabic language numerals and/or symbols, e.g. arithmetic symbols.

By "Arabic language numerals and/or symbols" is meant the system of numerals and symbols currently used in Arabic-speaking countries, as opposed to other systems of numerals and symbols currently in use in other parts of the world, for example of that used in Europe which has an Arabic derivation but which are identified herein or "European numerals as symbols" for clarity.

The difference between the Arabic and European systems of numerals and symbols, illustrated in FIGS. 1 and 2 of the drawings, and the different rules concerning the arrangement of digits and/or symbols in a given context presents a problem in existing devices where a predominantly numerical visual display is required, e.g. in calculators. For the European system of numerals and symbols, it is sufficient to activate selected line segments of a conventional 7 line segment display by appropriate number code input signals, usually binary coded decimal (B.C.D.) signals. It will be apparent that a conventional 7 line segment display is not adequate to display the Arabic numerals.

Previously, Arabic language numerals and symbols have been displayed using a "dot matrix" form of display device, which tends to be relatively costly and complex in construction. Moreover, the "dot matrix" form cannot be successfully applied to liquid crystal display, because in that case, problems arise in correct addressing of the liquid crystal "dots", yet liquid crystal displays are usually to be preferred because they provide a high contrast display which is independent of ambient lighting and requiring low drive power.

The need for a simple and relatively low cost device which can replace the European 7 line segment displays to receive the BCD input signals and provide the corresponding Arabic language numerals or symbols can be demonstrated by the large number of devices requiring a visual numerical display of one or more digits. Typical digital devices are:

(a) in domestic use: clock calenders, pocket calculators, oven timers, wrist watches, strap watches, thermometers.

(b) in industrial use: electronic digital instrumentation (e.g. numerical control devices), measuring devices (whether length, angle or position measurement), automatic balancing instruments, digital panel meters, data entry devices, (c) in the automotive industry: speedometers, revolution counters, fuel gauges, pressure gauges, petrol pumps.

(d) in commercial use: desk calculators, cash registers, weighing machines, Bank cash dispensers.

(e) in medical use: medical instrumentation.

It will be readily apparent that other systems of numerals and symbols can be used as a "base system" i.e. the system represented by the number code input signals, instead of the European system.

According to the present invention, there is provided apparatus for displaying visually Arabic language numerals and/or symbols, comprising a visual display including means for providing a visual image of a dot and a line segment display having at least eleven line segments, and a decoder for receiving a number code input signal representative of a numeral and/or symbol according to one system of numerals and symbols and for converting this input signal into a number code output signal representative of the corresponding Arabic language numeral and/or symbol, the decoder being connected to the visual display so that said number code output signal is supplied to the display to activate selected ones of the line segments and/or the dot image providing means thereof to provide a visual image of said corresponding Arabic language numeral and/or symbol.

The line segment display, which preferably has thirteen, fourteen, fifteen or sixteen line segments, may be of any suitable design, but is preferably a liquid crystal display. The pattern in which the line segments are arranged may be slanted to the left or to the right, or it may be upright.

The dot, which the Arabic language system denotes zero, may be provided by a decimal point in the line segment display located anywhere within the lower half of the segment pattern or by a second display immediately adjacent thereto.

To provide a visual image of multiple digit Arabic language numerals, several of the line segment displays can be provided in a predetermined pattern, depending on whether the device in which the apparatus is to be used is a calculator, digital clock etc. The decoder may include a single large scale integrated circuit to activate selectively each of the line segment displays, or alternatively, may include individual integrated circuits each connected to a respective one of the displays.

Conveniently, the decoder includes a read only memory which is mask-programmable to store a correlation between the input signals and the corresponding output signals, preferably with a $16\times16$ bit word organisation.

There now follows a description of various forms of the invention with reference to the accompanying drawings, of which;

FIG. 1 is a table illustrating the correlation between Arabic and European numerals;

FIG. 2 is a table illustrating the correlation between some Arabic and European arithmetic symbols;

FIGS. 3A, 3B and 3C illustrate three possible arrangements for the line segments of a 16 line segment display, being respectively left-slanted, upright and right-slanted;

FIG. 4 is a truth table illustrating the programme which correlates the number code input signals and the line segments which require activation to display the appropriate Arabic language numeral or symbol;

FIG. 6 is a table illustrating the correlation between the layout of some exemplary European multiple digit numerals and the corresponding Arabic language numeral.

Figure 5:
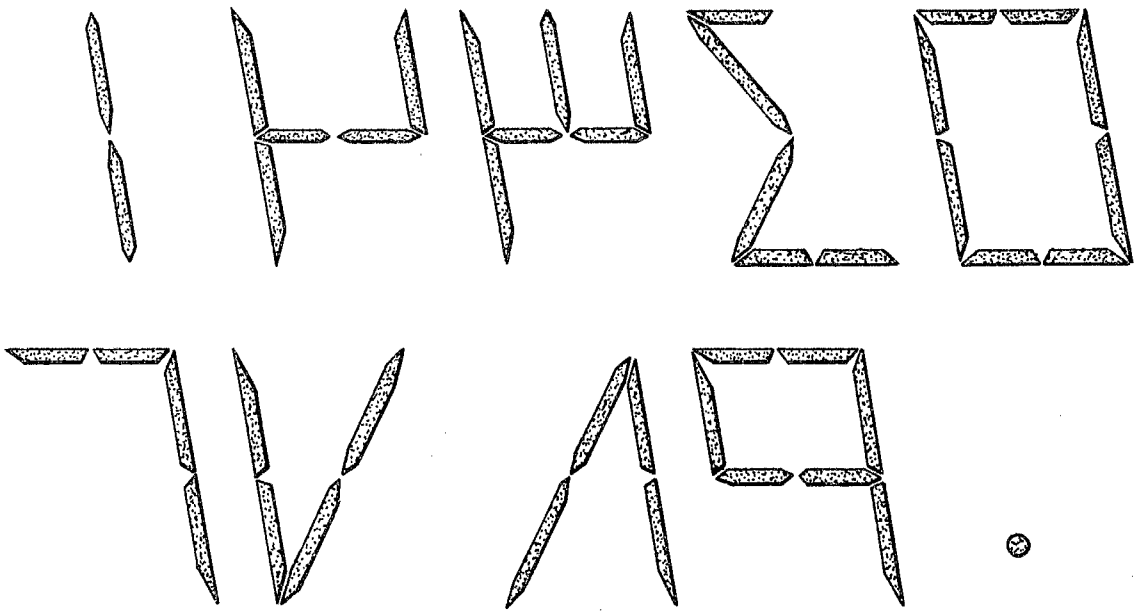
FIG. 5 illustrates the appearance of the Arabic language numerals corresponding to the European 0 to 9, when the segment pattern of FIG. 3A is used.

Apparatus according to the invention has two main components, namely a visual display and a decoder for activating the display. The display comprises one or more line segment displays each having at least eleven line segments which can be made visible in any given combination and means for providing a visual image of a dot which is the Arabic equivalent of the European zero.

The visual display may be of any suitable design capable of illuminating or otherwise making visible any given combination of the line segments in the or each line segment display. For example, the display may incorporate filaments, gas discharge means, light emitting diodes electro-mechanical means, fluorescent means or mask cathode ray tubes, but the preferred form is a liquid crystal display, particularly for use in strong sunlight, because this provides a high contrast display independent of ambient lighting yet requiring low power drive.

The or each line segment display has its line segments laid out in a pattern such as the parallelogram patterns shown in FIGS. 3A, 3B or 3C, with segments A1, A2 at the top, segments B, C and E, F at the sides, and segments D1, D2 at the base, and further segments G1, G2, H, I, J, K, L and M radiating between a central point and the corners or midpoints of the sides, top and base respectively as illustrated. The pattern may be a parallelogram which is slanted leftwards (FIG. 3A) or rightwards (FIG. 3C) or which is rectangular, i.e. upright (FIG. 3B). The left-slanted pattern of FIG. 3A is preferred since as seen in FIG. 1 most of the Arabic language numerals are actually inclined to the left, but the other patterns are also acceptable.

The position of the dot indicated by reference numeral 10 in FIGS. 3A–3C, which is used to form the Arabic language equivalent of zero may be anywhere within the lower half of the pattern. From a formal viewpoint, the correct position of the dot would be above the centre of the base but for convenience it can be offset from this location as illustrated in FIGS. 3A–3C. Alternatively, a separate display device located alongside the line segment display could be used to display the dot as required, but the arrangement illustrated is preferred. The output of the decoder is connected to the inputs to each line segment and to the dot of the or each line segment display. The input of the decoder is arranged for connection to the output of the digital device requiring the numerical display, e.g. a pocket calculator, so as to receive an encoded numerical input which is normally B.C.D. representing a numeral or symbol in the basic numeral system, in this example, the European system. The decoder is adapted to convert a particular B.C.D. input into output signals which activate the line segments or dot required to make visible the corresponding Arabic language numeral or symbol. The manner in which the decoder is programmed for a sixteen line segment display is illustrated in FIG. 4 which shows the decoder and display truth table for B.C.D. input. In this table a "1" represents a line segment or dot made visible and a space indicates an invisible line segment or dot. The identification of the line segment used in this table corresponds to the rotation used in FIGS. 3A–3C.

It should be noted from FIG. 1, that there are two possible forms for the Arabic language numeral two, with the first being more popular. The display truth table is generally correct for left or right slanted and upright segmented patterns. The patterns for the Arabic language numerals seven and eight are correct for left slanted and upright patterns only, with the right slanted patterns being given at the end of the truth table. Redundant segments, i.e., those which are not required for the Arabic language numeral patterns, could be omitted from the display device, as described hereinafter. Also segments which are next to each other and which are usually illuminated or made visible together could be replaced by a single segment in the display device. One example of segment simplification is the G1 and G2 segments which are always illuminated or made visible together and can be replaced by a single segment in the display device and use only a single decoder output G, reducing the number of line segments needed to fifteen.

Display devices with 14 segments in which the A1 and A2, D1 and D2 segments are combined to give an A and D segment, can also be used, provided the loss of shape for the Arabic numeral four is acceptable, in which case the decoder A1 and D2 outputs would be used.

It will therefore be apparent that if all three pairs of segments G1, G2 or A1, A2, or D1, D2 are replaced by single segments G, A and D respectively, only 13 segments in all would be needed.

FIG. 5 shows the Arabic language numerals equivalent to the European numerals 1 to 9 and 0 illuminated or otherwise made visible having a line segment pattern which is slanted leftwards as in FIG. 3A.

Where a plurality of line segment displays are used in the display of multiple digit numerals, the decoder may either include a multiplexer device so that a single large scale integration (L.S.I) circuit may be used to activate each of the line segment displays in turn, or alternatively the decoder may incorporate individual integrated circuits, one for each line segment display.

The decoder preferably incorporates a read only memory or logic circuit which is mask-programmed with the correlation information illustrated in tabular form in FIG. 4. The memory should preferably use word organisation, e.g. a 12 bit word organisation, each word length being typically 16 bits. This allows the individual digit and symbol display patterns to be held in individual memory words. Using a read only memory with $16\times16$ bit word organisation, the binary address inputs can be used directly as the B.C.D. display input.

If a memory with a $32\times16$ bit word organisation is used, it would be possible to provide a visual display of either the European numeral or symbol or its Arabic equivalent. To do this, the first 16 words of the memory would be used to activate the Arabic language line segment displays whilst the last 16 words would be used to control the question of conventional 7 line segment displays to shake shape the European numeral or symbol visible. Such a memory has five binary address inputs $2^0$, $2^1$, $2^2$, $2^3$ and $2^4$. The inputs $2^0$ to $2^3$ inclusive could be used as before for the BCD display input for the Arabic language numerical display, and the address input $2^4$ could be used to select either the first 16 words or the last 16 words to produce a display of either the Arabic language or European numerals respectively.

The rules regarding the position of the arithmetic symbols in the Arabic system differ from those of the European system, and the decoder must be arranged to take note of this. As in European numerals, the least significant digit of an Arabic language numeral is written on the right hand side (FIG. 6A). However, although the plus and minus symbols are the same in the Arabic language system as in the European system, they appear on the right hand side of the numeral in the Arabic language system rather than on the left as in the European system (FIG. 6B). The reverse applies to quantity symbols such as the "percent" symbol (FIG. 6D). The reason for this is that Arabic is read from right to left rather than vice versa.

As previously indicated, one dot character is used in Arabic to denote zero, and must not be confused with the European decimal point which in Arabic has the form of a European comma. The use and position of the decimal point symbol is identical in both systems (FIG. 6C).

Figure 7A:
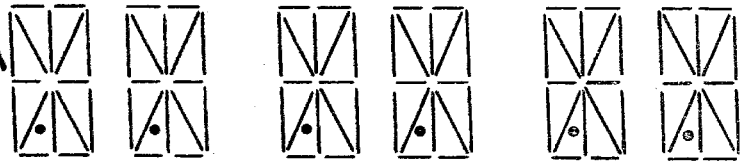
FIGS. 7A, 7B and 7C illustrate some typical arrays for the line segment displays for specific uses.
Figure 7B:
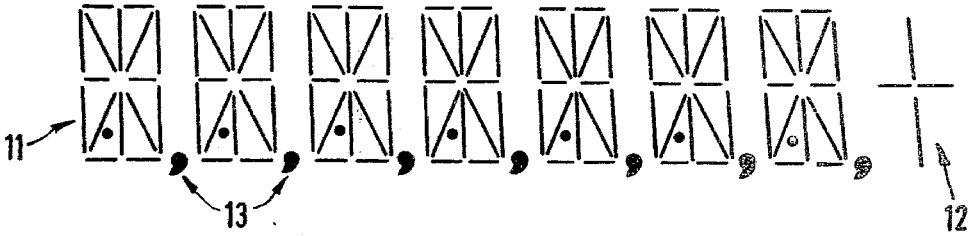

FIG. 7A shows an array of sixteen-line segment displays suitable for use in a digital clock displaying Arabid language numerals, the line segment displays being arranged in pairs, with the pairs equispaced, to denote the hour, minute and second data. FIG. 7B on the other hand shows a suitable array for a calculator capable of displaying seven digit numerals, or six digit numerals with a quantity symbol, such as "percent" symbol in the left hand line segment display indicated at 11. It should be noted that where the "percent" symbol or other quantity or arithmetic symbols e.g. those symbols indicated in FIG. 2 are to be used, the left hand segment display 11 and the right hand segment display indicated at 12 are correspondingly adapted. For example, the segment display 12 may be adapted as shown in FIG. 7 to be capable of displaying only the plus and minus symbols. Between each pair of adjacent line segment displays is a display 13 capable of providing a visual image of the Arabic equivalent of the European decimal point.

Figure 7C:
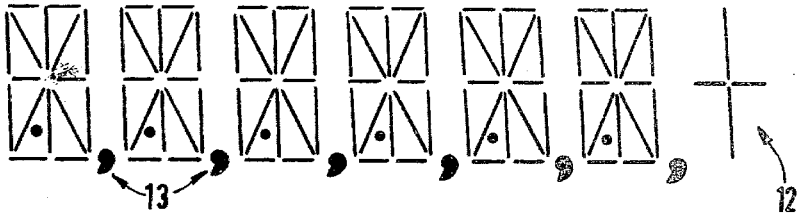

FIG. 7C shows a similar array to that of FIG. 7B, except that the quantity symbol line segment display 11 is omitted, for use in other devices requiring simple numerical displays.

It will be readily apparent that other arrays of line segment displays are possible, depending on the device in which the apparatus is to be incorporated.

As described above, redundant line segments of each line segment display may be omitted without detriment. For example, segments L and K in left-slanted or upright displays, or segments L and J in right slanted displays may be omitted. This is possible by moving the Arabic language numeral one from its central position (which is formally correct) to the side of the display i.e. to the left or right hand side) if no arithmetic or other symbols requiring segment L need to be displayed. Segment K is redundant in left slanted or upright displays if the second form of the Arabic language numeral two is not used, whereas segment J is redundant in right slanted displays due to the form of the Arabic language numerals seven and eight. Thus the minimum number of line segments required for each segment display is eleven.

We claim:

1. Apparatus for displaying visually Arabic language numerals and/or symbols, comprising a visual display including means for providing a visual image of a dot and a line segment display having at least eleven straight line segments including upper, middle and lower, parallel, cross-wise line segments, a left pair of aligned, upright line segments and parallel therewith a right pair of aligned, upright line segments extending from the left end and right end respectively of the middle, cross-wise line segment to respective left ends and respective right ends respectively of the upper and lower, cross-wise line segments, thereby constituting a conventional seven segment array, a middle, upright line segment extending between the centres of the middle and upper, cross-wise, line segments, and diagonal line segments extending from the center of the middle, cross-wise line segment to the left ends of and at least one of the right ends of the upper and lower, cross-wise line segments, and a decoder for receiving number code input signals utilized in conjunction with a conventional seven segment array to display individual numerals and/or symbols according to one system of numerals and symbols and for converting these signals into number code output signals which are utilized by said visual display means to display individual Arabic language numerals and/or symbols, the decoder being connected to the visual display means so that said number code output signals are supplied to activate those selected ones of the line segments and/or the dot image thereof which provide visual images of said individual Arabic language numerals and/or symbols corresponding to said individual numerals and/or symbols of said one system.

2. Apparatus as claimed in claim 1, in which the line segment display is a liquid crystal display.

3. Apparatus as claimed in claim 1 or claim 2, in which the pattern in which the line segments are arranged is left-slanted.

4. Apparatus as claimed in claim 1 or claim 2, in which the pattern in which the line segments are arranged is upright.

5. Apparatus as claimed in claim 1 or claim 2, in which the pattern in which the line segments are arranged is right-slanted.

6. Apparatus as claimed in claim 1, in which the dot image forming means is constituted by a dot incorporated in the line segment pattern, the dot being located within the lower half of the segment pattern.

7. Apparatus as claimed in claim 1, in which the dot image forming means comprises a second display is provided immediately adjacent said line segment display.

8. Apparatus as claimed in claim 1, wherein the line segment display further comprises a lower, upright line segment extending between the centres of the middle and lower, cross-wise line segments.

9. Apparatus as claimed in claim 1, wherein at least one of the upper, middle and lower, cross-wise line segments is constituted by a pair of aligned, cross-wise line segments arranged end to end.

* * * * *